United States Patent [19]

Huang

[11] Patent Number: 4,902,002

[45] Date of Patent: Feb. 20, 1990

[54] EXERCISE APPARATUS

[76] Inventor: Kou-Min Huang, #181, Lane 412, Chen-hsing Rd., Tai-Chung, Taiwan

[21] Appl. No.: 264,064

[22] Filed: Oct. 28, 1988

[51] Int. Cl.[4] ..... A63B 21/00

[52] U.S. Cl. ..... 272/73; 272/131; 272/DIG. 4

[58] Field of Search ..... 272/73, 103, 70, 71, 272/72, 67, 68, 62, 63, 131, 93, 96, 132; 128/25 R

[56] References Cited

U.S. PATENT DOCUMENTS 3,685,511 8/1972 Alvarez ..... 272/73

FOREIGN PATENT DOCUMENTS 0142098 2/1950 Australia ..... 272/103

3046117 7/1982 Fed. Rep. of Germany ..... 272/73

*Primary Examiner*—Stephen R. Crow

*Attorney, Agent, or Firm*—Leonard Bloom

[57] ABSTRACT

A vertical type body-building exercise apparatus is furnished with a supporting frame, a hand-exercising mechanism and a foot-exercising mechanism. Both mechanisms are substantially parallel and connected to the supporting frame. Both mechanisms are symmetrical such that one handle or pedal is downward when the other handle or pedal is upward. The height of the hand-exercising mechanism can be adjusted according to the practical necessities by using a height adjusting device. Furthermore, the present invention can offer an effective body-exercise simply through use of two revolving mechanisms by both hands and feet at the same time. Alternatively, the hand and the foot mechanism may be used independently of one another.

7 Claims, 3 Drawing Sheets

EXERCISE APPARATUS

FIELD OF THE INVENTION

The present invention relates to an exercise apparatus, more particularly to a vertical type body-building rack.

BACKGROUND OF THE INVENTION

The present invention is to provide a vertical type body-building rack which is furnished with the upper and the lower exercise mechanisms in parallel for hand and foot exercise by the user. The upper exercise mechanism is adjustably mounted on the upper rack and the lower exercise mechanism is firmly mounted on the lower rack. The scope of usage of conventional single-unit body-building equipment is limited since it is designed to do body-exercising only for a fixed part of the human body.

Also, it does not achieve the goal of obtaining equilibrium exercise. An assembly type body-building equipment designed for physical exercise in any part of the human body is available. But, it requires much space, and is also of higher cost than the single-unit and has not met the needs of the popular market.

SUMMARY OF THE INVENTION

The object of the present invention is to provide a body-building rack exercising apparatus which is designed for whole body exercise through the rotary exercise of only the arms and legs with the upper and the lower exercise mechanism.

Techniques, equipment, accessories and its effects for the above and other objects, features and advantages of the present invention will become more apparent from the following description when taken in conjunction with the accompanying drawings in which preferred embodiments of the present invention are shown by way of illustrative example. But, special terms of equipment and accessories are only for explanation are not limited.

DESCRIPTION OF THE PREFERRED EMBODIMENTS

Figure 1:
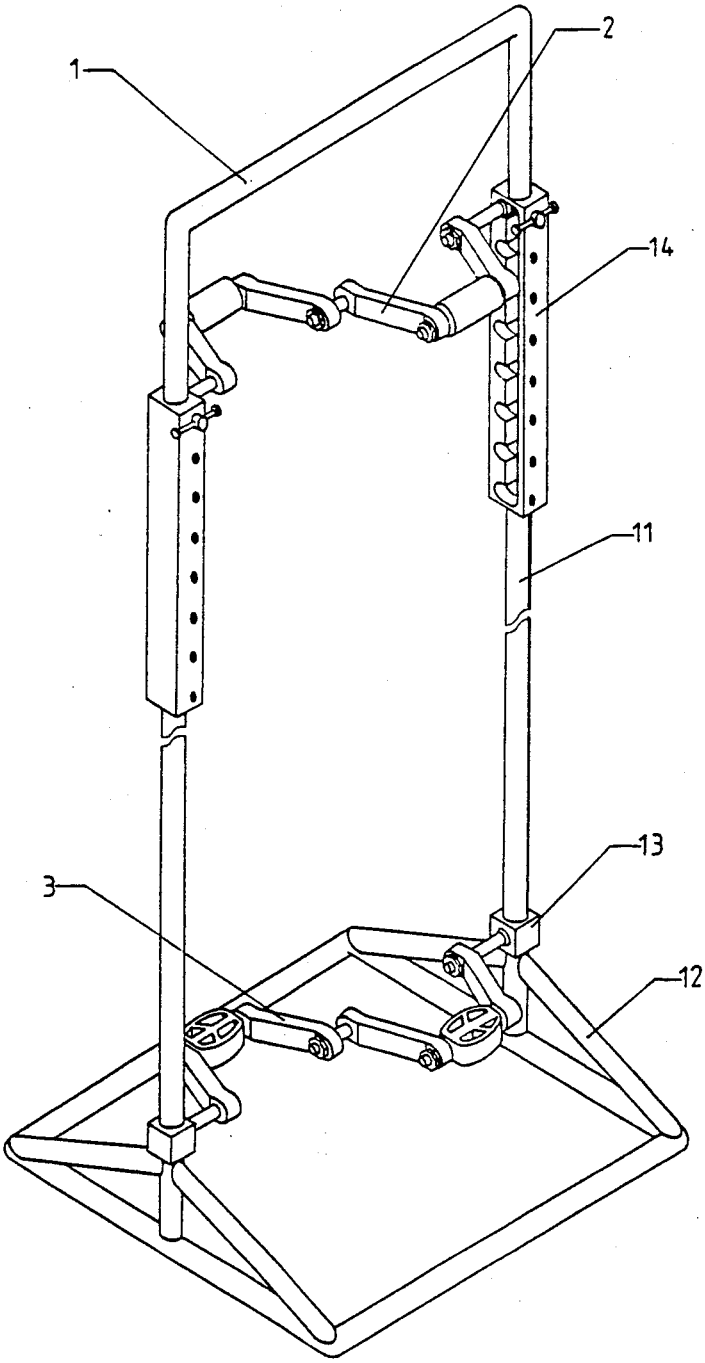
FIG. 1 is a perspective view of the present invention.
Figure 2:
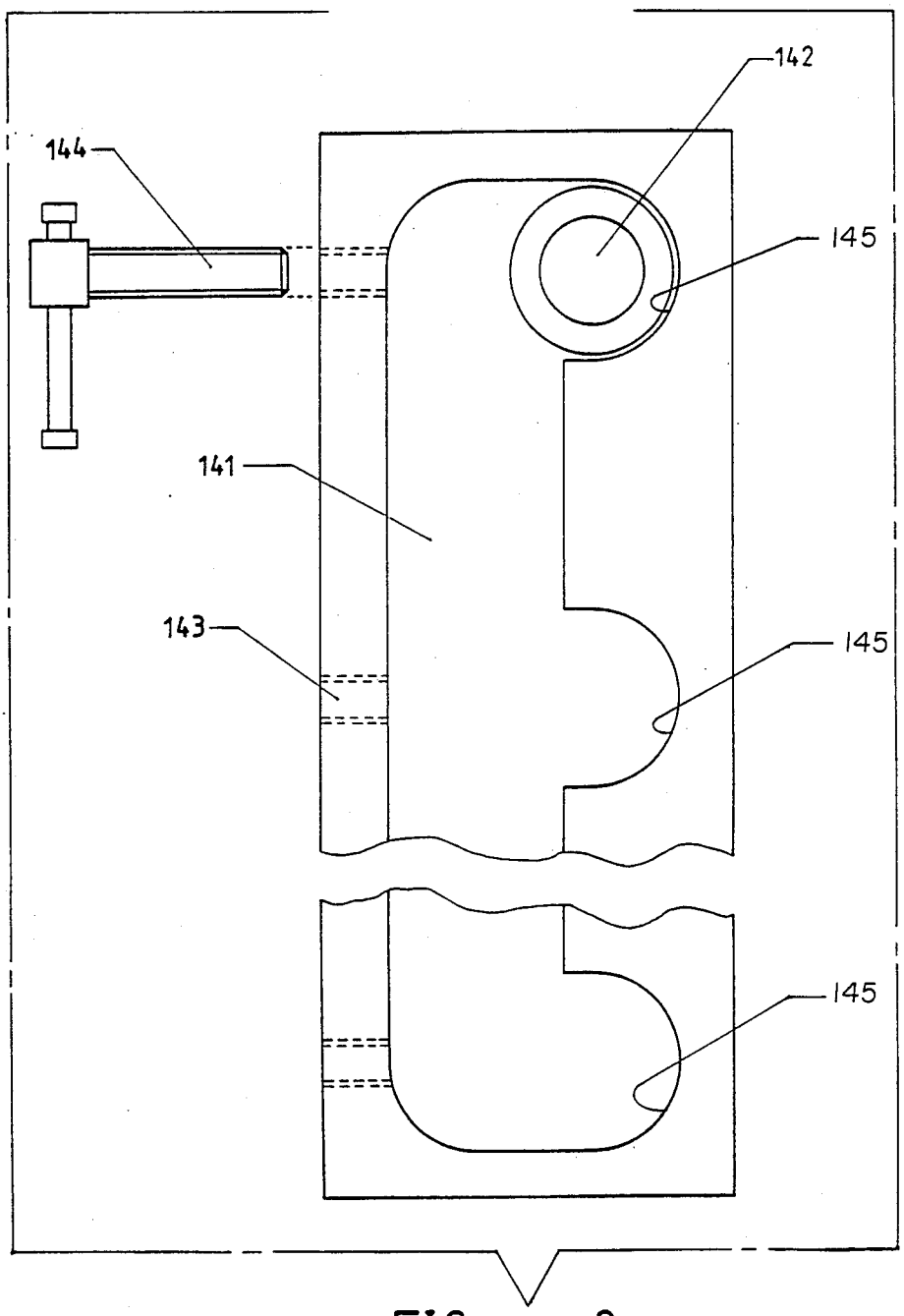
FIG. 2 is a front view of the position-adjusting device of the present invention.
Figure 3:
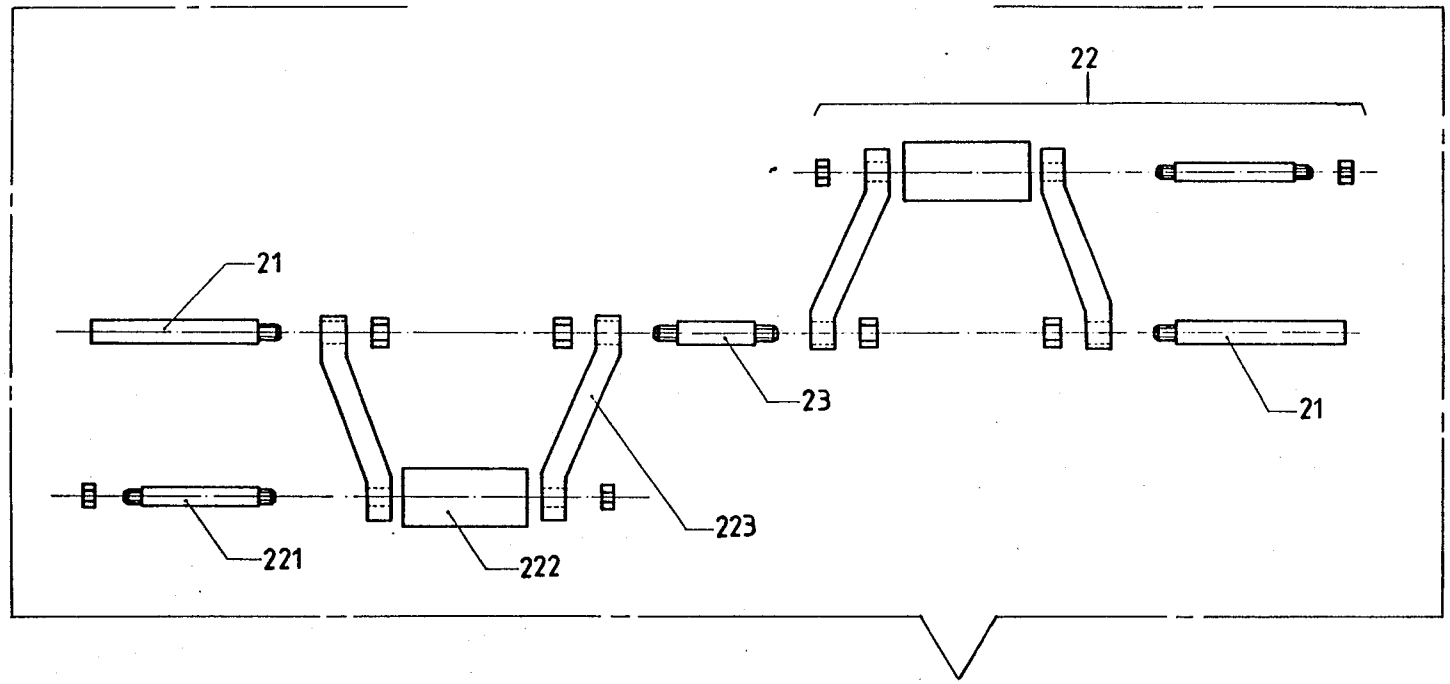
FIG. 3 is an exploded view of the hand-exercising mechanism of the present invention.

The vertical type body-building rack according to the present invention generally consists of a supporting frame 1, a hand-exercising mechanism 2 and a foot-exercising mechanism 3, in which, both two mechanisms are furnished in parallel and connected to the frame 1 respectively with the upper and the lower shaft bearings. The detailed descriptions are as follows: As illustrated in FIG. 1, the frame 1 comprises a substantially inverted U-shaped vertical stand 11 with two parallel legs and a base 12. As shown in FIG. 1, the base 12 is substantially rectangular. The legs of the vertical stand 11 are received at the midpoints of the first side and the opposite second side of the base 12. The base 12 further has supporting struts from each end of the first side of the base and each end of the second side of the base to a position on the legs of the vertical stand 11, above the base 12. The lower part of said stand 11 is furnished with the left (first) and the right (second) shaft bearing members 13 and the higher part of said stand 11 is furnished with the left (first) and the right (second) position-adjusting devices 14. The member 13 is cubic in form, in which, there is a shaft bearing for connecting the mechanism 3. The position adjusting device 14, as illustrated in FIG. 2, is vertically mounted on the legs of the stand 11. The device 14 has a slotted vertical opening 141 in a rectangular body having a series of vertically spaced semi-circular pockets 145 adjacent to, and in communication with, the slot 141. A shaft bearing 142 may be received in the pocket 145. The diameter of the pocket is a little larger than the outside diameter of the bearing 142. The leftside (first) wall of said groove (slots) 141, corresponding to the grooves (pockets) on the rightside (second) wall, is furnished with vertically spaced tapped screw holes 143 which can secure the bearing 142 into any pockets in a rightside (second) wall by using the removable threaded screw rod with handle 144. The axial line of the tapped screw hole meets with the central point of the bearing. Every pocket of the rightside (second) wall may receive the bearing. The depth of the pocket is at least larger than the radius of the bearing. As shown in FIG. 2, preferably the depth of the pocket is two-thirds of the diameter of the bearing. The pockets are semi-circular, complementary to the bearing. Said mechanism 2 is comprised of the left (first) and the right (second) shafts 21, the left (first) and the right (second) revolving mechanisms 22 and a connecting rod 23, as illustrated in FIG. 3. The shafts 21 are respectively connected to the position adjustment devices 14 in order and extend inwardly therefrom. The ends of the shafts 21 are respectively secured to two mechanisms 22 which are symmetrically assembled in such a way that one is downward when the other is upward. The two mechanisms 22 are secured by a connecting rod 23 which is at the same axial line as two shafts 21. Said mechanisms 22 is comprised of screws 221, handle bars 222 and left (first) and right (second) cranks 223. The screws 221 pass through the handle bars 222. The cranks 223 have an offset shape which is wider at one end and narrower at the other end. The handle bars 222 are mounted at the narrow end of the cranks. The revolving mechanism is symmetrically revolved upwardly and downwardly corresponding to the connecting rod. It is very easy for the user to adjust the mechanism 2 by disassembling the handle 144 of the position adjustment devices 14, levelling the mechanism 2 to the desired height and securing the screw 221.

Mechanism 3 is comprised of the left (first) and the right (left) shafts 21, the left (first) and the right (second) revolving mechanisms 22 and a connecting rod, in which, the left and the right shafts are respectively connected to the shaft bearing of the shaft bearing member 13. The assembling of elements, and the revolving are the same as the mechanism 2 except the handle bars 222 of the mechanism 2 are replaced with the pedals of the mechanism 3.

The detailed description is as follows: the present invention is suitable for users who are of different height and offers the height-adjusting function for the mechanism 2 according to the users' exercising habits. When the user only wants to use the hand-exercising mechanism 2, the elbow and the shoulder exercise functions can be used through the revolving of the mechanism 2. The height is adjusted to meet the users' requirements simply by adjusting the position adjustment devices 14 and stepping on the mechanism 3.

Furthermore, the present invention provides better exercising effects than the high bar does because, when the height of the mechanism 2 is sufficient so the user's feet do not contact the ground or the foot exercise mechanism 3, the user has only hand support and exercises by revolving the mechanism 2.

If the user only wants to use the foot-exercising mechanism 3, the present invention can offer good balancing effects in the revolving of the mechanism 3. When the feet support the whole of the user's body and the user pedals slowly, the same effects are achieved as with jogging and bicycle-riding.

In case of using both hands and feet at the same time, the waist and the abdomen will be exercised.

As above-mentioned, the vertical type body-building rack according to the present invention is not only used as the single-unit body-building equipment, but also used as the equilibrium body-building equipment for whole human body.

Although certain preferred embodiments have been shown and described, it should be understood that many changes and modifications may be made therein without departing from the scope of the appended claims.

I claim:

1. An exercise apparatus comprising:

a supporting frame in the form of an inverted U-shaped vertical stand having a first leg and a second leg, the stand having an upper part and a lower part;

a substantially rectangular base having a first side and an opposite second side, each side having a midpoint, a first end and second end, the first leg of the vertical stand being received at the midpoint of the first side of the base and the second leg of the vertical stand being received at the midpoint of the second side of the base;

four supporting struts, a strut being connected respectively from the first end and the second end of each respective first side of the base and second side of the base to the respective leg of the vertical stand thereby stably supporting the vertical stand;

a first and a second shaft bearing member, each member mounted on a respective leg of the vertical stand in the lower part of the stand;

a foot exercising mechanism axially and rotatably connected transversely between the shaft bearing members, the foot exercising mechanism having a first shaft and a second shaft received by the first and second shaft bearing members respectively, further having a first and a second revolving pedal and a connecting rod between the first and second pedals such that the first pedal and the second pedal are disposed in opposite upward and downward positions with respect to one another;

a first and a second position adjusting device, each position adjusting device being mounted on the upper part of the stand on the first leg and the second leg respectively, each position adjusting device having a rectangular body having a vertical slotted opening therein, the slotted opening having a first side and an opposite second side, further having a series of vertically spaced semi-circular pockets communicating with the first side of slotted opening, each pocket having a diameter, the second side of the slotted opening further communicating with a series of vertically spaced tapped screw holes, the screw holes being aligned opposite to the pockets, a threaded screw rod with a handle removably received by the screw hole such that the screw rod with handle may be disposed in the screw opening and communicate with the pocket opposite thereto;

a hand exercising mechanism axially and rotatably connected transversely between the position adjusting device, the hand exercising mechanism having a first shaft and a second shaft, each shaft having an outside diameter less than the diameter of the pocket in the position adjusting device, a first and a second revolving handle bar and a connecting rod between the handle bars such that the first shaft and the second shaft are received in the pockets, the first and the second position adjusting device and may be secured in the desired pocket by the screw handle and when so received, the first handle bar and the second handle bar are disposed in opposite upward and downward positions with respect to one another; and the foot exercising mechanism and the hand exercising mechanism being substantially parallel to one another, each independently operable, the hand exercising mechanism being adjustable in height as desired to meet the requirements of the user.

2. An exercise apparatus comprising:

a supporting frame having a vertical stand having a first leg and second leg and a base, the legs of the stand being received by and supported in an upright position by the base, the stand having an upper part and a lower part;

a hand exercising mechanism rotatably mounted on the upper part of the stand transversely between the legs of the stand;

means for adjusting the vertical position of the hand exercising mechanism with respect to the base as desired to meet the requirements of the user wherein said means for adjusting the vertical position of the hand exercising mechanism comprises a first and a second position adjusting device, each position adjusting device being mounted on the upper part of the stand on the first leg and on the second leg respectively, each position adjusting device having a rectangular body having a vertical slotted opening therein, the slotted opening having a first side and an opposite second side, further having a series of vertically spaced semi-circular pockets communicating with the first side of the slotted opening, each pocket having a diameter, the second side of the slotted opening further communicating with a series of vertically spaced tapped screw holes, the screw holes being aligned opposite to the pockets, a threaded screw rod with handle removably received by the screw hole such that the screw rod with handle may be disposed in the screw opening and communicate with the pocket opposite thereto, the hand exercising mechanism having a first shaft and a second shaft, each shaft having an outside diameter less than the diameter of the pocket in the position adjusting device such that the shafts of the hand exercising mechanism may be received in the desired pockets in the position adjusting device and may be secured therein with the screw rod with handle;

a foot exercising mechanism rotatably mounted on the lower part of the stand transversely between the legs; and such that the hand exercising mechanism and the foot exercising mechanism are substantially parallel to one another, the hand exercising mechanism and the foot exercising mechanism being both independently operable and operable concurrently.

3. The exercise apparatus of claim 2, wherein the stand has a substantially inverted "U" shape.

4. The exercise apparatus of claim 2, wherein the base is rectangular having a first side and an opposite second side, each side having a midpoint, a first end and a second end, the first leg of the vertical stand being received at the midpoint of the first side of the base and the second leg of the vertical stand being received at the midpoint of the second side of the base; four supporting struts, a strut being connected respectively from the first end and the second end of each respective first side of the base and second side of the base to the respective legs of the vertical stand thereby stably supporting the vertical stand.

5. The exercise apparatus of claim 3, wherein the pocket has a depth, the depth of the pocket being two-thirds of the diameter of the shaft.

6. The exercise apparatus of claim 2, wherein the hand exercising mechanism has a first and a second revolvable handle bar, the first handle bar and the second handle bar being disposed in opposite upward and downward positions with respect to one another.

7. The exercise apparatus of claim 2, wherein the foot exercising mechanism has a first and a second revolving pedal, the first pedal and the second pedal being disposed in opposite upward and downward positions with respect to one another.

* * * * *